US006303281B1

(12) United States Patent
Wang et al.

(10) Patent No.: US 6,303,281 B1
(45) Date of Patent: Oct. 16, 2001

(54) PHOTOGRAPHIC ELEMENT HAVING IMPROVED SCRATCH AND ABRASION RESISTANCE

(75) Inventors: Yongcai Wang, Penfield; Melvin Michael Kestner, Hilton; Alfred Bruce Fant; Dennis Edward Smith, both of Rochester, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 08/603,560

(22) Filed: Feb. 21, 1996

(51) Int. Cl.[7] ..... G03C 1/76

(52) U.S. Cl. ..... 430/523; 430/961; 430/950; 430/936; 430/527; 430/529; 430/533; 430/536; 430/628; 430/507; 430/512; 430/931

(58) Field of Search ..... 430/523, 961, 430/950, 936, 529, 527, 533, 536, 628, 507, 931, 572

(56) References Cited

U.S. PATENT DOCUMENTS

| | | | | |
|---|---|---|---|---|
| 4,374,919 | * | 2/1983 | Toriuchi | 430/512 |
| 4,388,402 | * | 6/1983 | Mukunoki et al. | 430/536 |
| 4,464,462 | * | 8/1984 | Sugimoto et al. | 430/523 |
| 4,551,412 | | 11/1985 | Ogawa et al. | 430/265 |
| 4,551,420 | * | 11/1985 | Sugimoto et al. | 430/931 |
| 4,588,673 | | 5/1986 | Kataoka et al. | 430/264 |
| 4,822,727 | | 4/1989 | Ishigaki et al. | 430/536 |
| 4,904,578 | * | 2/1990 | Tanaka et al. | 430/512 |
| 5,330,885 | | 7/1994 | Takamuki et al. | 430/523 |
| 5,364,749 | * | 11/1994 | Leppard et al. | 430/507 |
| 5,370,982 | * | 12/1994 | Tashiro et al. | 430/512 |
| 5,770,353 | * | 6/1998 | Wang et al. | 430/512 |
| 5,866,312 | * | 2/1999 | Wang et al. | 430/512 |

FOREIGN PATENT DOCUMENTS

| | | |
|---|---|---|
| 0 395 956 A2 | 11/1990 | (EP) . |
| 0 556 002 A1 | 8/1993 | (EP) . |
| 0 613 047 A3 | 8/1994 | (EP) . |
| 0 614 113 A2 | 9/1994 | (EP) . |
| 6/266036 | 9/1994 | (JP) . |

* cited by examiner

*Primary Examiner*—Geraldine Letscher
(74) *Attorney, Agent, or Firm*—Doreen M. Wells

(57) ABSTRACT

A silver halide photographic element comprises a support having thereon at least one light-sensitive silver halide emulsion layer and a light-insensitive protective layer, the light-insensitive protective layer comprising an ultraviolet absorbing layer closer to the support and an outermost protective layer, the ultraviolet absorbing layer comprising an ultraviolet aborbing dye, a high boiling organic solvent, and a hydrophilic binder, the outermost protective layer comprising insoluble matte particles having a mean particle size of larger than 0.5 $\mu$m, dispersed polymer particles having a mean size of less than 0.2 $\mu$m, and a glass transition temperature of at least 70° C., and a hydrophilic binder.

16 Claims, No Drawings

PHOTOGRAPHIC ELEMENT HAVING IMPROVED SCRATCH AND ABRASION RESISTANCE

BACKGROUND OF THE INVENTION

1. Field of the Invention

This invention relates to an imaging element, and in particular to a silver halide photographic element with improved scratch and abrasion resistance.

It is conventional to incorporate an absorbing dye, in particular, an ultraviolet ray absorbing dye, into a light-insensitive layer in a photographic element to absorb light in a specific wavelength region. The dyed light-insensitive layer is used, f ample, to control the spectral composition of light incident upon a photographic emulsion layer, to act as an antihalation layer between the support and the photographic emulsion layer or on the side of the support opposite to the photographic emulsion layer to prevent halation caused by light scattering during and after the passage of light through the photographic emulsion layer. In addition, the dyed light-insensitive layer is used to absorb or to remove ultraviolet light produced by static discharge, which occurs when the surfaces of the photographic element come into contact during production or treatment processes. Electric charges are generated by friction of separation. When accumulation of static electricity by charging reaches a certain limiting value, atmospheric discharge occurs at a particular moment and a discharge spark fires at the same time. When the photographic element is exposed to light by discharging, static marks appear after development.

2. Description of Related Art

Different methods for incorporating absorbing dyes into a non-imaging layer have been described in, for example, U.S. Pat. Nos. 2,739,888, 3,352,681, and 3,707,375 where an oil soluble dye is dissolved in a high boiling organic solvent, and mixed under high shear or turbulence together with an aqueous medium, which may also contain a surfactant, and/or gelatin in order to break the organic phase into submicron particles dispersed in the continuous aqueous phase. However, when such dye dispersions are used in a light-insensitive layer, the layer becomes soft and the mechanical properties of the layer are lowered. Furthermore, many dyes themselves are liquid, and they therefore can have a detrimental effect on the mechanical properties of the layer and adhesion with the adjacent layer.

The weakening of light-insensitive layers by an absorbing dye dispersion, in particular by an ultraviolet absorbing dye dispersion, has been a serious problem in, for example, color light sensitive materials, where a light-insensitive layer containing an ultraviolet dye dispersion is often coated as a protective layer on the top of the emulsion layer to remove the ultraviolet light generated by static discharge and for correct color reproduction. Since it is desired to record only visible light, the influence of the ultraviolet light is very apparent. For example, when photographing objects which have a comparatively large quantity of spectral energy in the ultraviolet region, such as a distant view, a snow scene, or an asphalted road, etc. the resulting color images are rich in blue color. Accordingly, in order to obtain color photographic images which have correct color reproduction, it is desired to prevent ultraviolet rays from reaching the silver halide emulsion layers. Very often, another light-insensitive layer containing a matting agent is coated as the topmost layer above the light-insensitive layer containing the ultraviolet absorbing dye dispersions for better resistance to ferrotyping and sticking at high temperature and in moist environments. Photographic materials with such layer structures often show inferior physical and mechanical properties during various handling processes, such as coating, drying, finishing, winding, rewinding, printing, and so on. For example, the photographic material surfaces are easily harmed by contact friction with other apparatus and between their front and back faces. Scratches and abrasion marks can be generated. These generated scratches and abrasion marks deface the image during printing and projection processes. On irreplaceable negatives, the physical scratches may require very expensive retouching.

Various methods have been proposed to obtain a physically improved photographic material by reducing the contact friction of the photographic material to other surfaces so that it will not be damaged during the manufacturing, exposure, developing and printing or projecting processes. For example, methods for reducing the contact friction were described in U.S. Pat. No. 3,042,522 by incorporating both a silicone fluid and a certain surface active agent into the protective overcoat, in U.S. Pat. No. 3,080,317 by using a mixture of dimethyl silicone and diphenyl silicone on the backside of the support, in GB Patent No. 1,143,118 by incorporating a triphenyl terminated methyl phenyl silicone into the emulsion protective overcoat, in U.S. Pat. No. 3,489,567 by using a combination of dimethyl silicone and beta-alanine derived surfactants, in U.S. Pat. No. 3,121,060 by using modified sperm oils in the protective overcoat, in U.S. Pat. No. 4,004,927 by using liquid organopolysiloxane with methyl and alkyl ($>C_1$) or aryl, or aryalkyl side groups in the protective overcoat, and in U.S. Pat. No. 4,047,958 by using polysiloxane with polyether side chains on the backside of the support.

Various methods have also been proposed to reinforce the surface overcoat layer, for example, in GB Patent No. 1,270,578 by adding a certain class of hardener to gelatin, in U.S. Pat. No. 3,053,662 by using colloidal silica in the overcoat layer, in U.S. Pat. No. 4,268,623 by using colloidal silica in combination with a water soluble polymer having a carboxylic acid group in the overcoat layer, in U.S. Pat. No. 4,777,113 by using two overcoat layers, the upper layer containing a colloidal silica and the lower layer containing a polymer latex, and in U.S. Pat. No. 4,914,012 by using a composite latex comprising a polymeric acrylic acid ester and/or a polymeric methacrylate acid ester and colloidal silica. However, the use of colloidal silica particles in the surface protective layer suffers from a number of disadvantages; for example, they increase significantly the coating solution viscosities; they increase the brittleness of the protective layer; they adhere to wall surfaces and therefore give rise to extensive cleaning of equipment and increased labor cost; and they are highly abrasive and therefore may increase the wear of manufacturing and processing equipments.

In recent years, the conditions under which the photographic materials are manufactured or utilized have become even more severe, either because their applications have been extended, for example, in an atmosphere of high humidity and high temperature, or because the methods for their preparation have been advanced, for example, the use of high speed coatings, high speed finishing and cutting, and fast processing, or because their emulsion layers have been progressively thinned. Under these conditions, the aforementioned photographic materials are more severely scratched.

SUMMARY OF THE INVENTION

Therefore, a foremost objective of the present invention is to provide a silver halide photographic material which exhibits excellent resistance to physical scratches and abrasions.

In accordance with the present invention, a silver halide photographic element comprises a support, at least one light-sensitive silver halide emulsion layer, and a light-insensitive protective layer, the light-insensitive protective layer including at least two layers, with the layer closer to the support comprising at least one ultraviolet ray absorbing dye, a high boiling organic solvent, and a hydrophilic binder, and with the layer farthest from the support (outermost layer) comprising a processing surviving matting agent (matte particles) having a mean particle size of from 0.5 to 10 μm, a dispersed polymer particle having a mean size of less than 0.2 μm, preferably from 0.01 to 0.2 μm and a glass transition temperature of at least 70° C., and a hydrophilic binder.

DESCRIPTION OF PREFERRED EMBODIMENTS

The photographic element of the present invention has a light-insensitive hydrophilic protective layer comprising at least two layers, the layer (UV layer) closer to the support contains at least one ultraviolet absorbing dye, a high boiling organic solvent, and a hydrophilic binder. The layer farthest from the support (outermost layer) contains matte particles, dispersed polymer particles, and a hydrophilic binder. The matte particles in the outermost layer have a mean particle size of from 0.5 to 10 μm, preferably from 1 to 5 μm, and most preferably from 1 to 3 μm, and a coating weight of from 0.001 g/m$^2$ to 0.3 g/m$^2$, preferably from 0.005 g/m$^2$ to 0.2 g/m$^2$, and most preferably from 0.01 to 0.15 g/m$^2$. The dispersed polymer particle in the outermost layer has a glass transition temperature (Tg) of at least 70° C., a mean particle size of less than 0.2 μm, preferably from 0.01 μm to 0.2 μm, more preferably from 0.02 to 0.15 μm, and most preferably from 0.02 to 0.1 μm. The weight ratio of dispersed polymer particle to hydrophilic binder in the outermost protective layer ranges from 5:95 to 50:50, preferably from 10:90 to 40:60, and most preferably from 20:80 to 40:60.

The content of the hydrophilic binder in the UV layer is defined as the ratio of coating weight of the hydrophilic binder to the sum of the coating weights of the ultraviolet absorbing dyes, high boiling organic solvents, the hydrophilic binder, and other addenda, and is preferably in the range of from 30 to 90%, and more preferably from 40 to 80%. The thickness of the UV layer of the present invention is usually 0.2 to 3 μm, and preferably from 0.5 to 2 μm. The thickness of the outermost layer is usually 0.4 to 3 μm, and more preferably 0.6 to 2 μm. The total thickness of the two layers is 1.5 to 4 μm. The term "thickness" used here refers to the thickness of the portion in which no matte particles are present and is measured, for example, by an electron micrograph of a non-swollen cross-section of the light-sensitive material.

Photographic elements according to this invention can differ widely in structure and composition. For example, they can vary greatly in regard to the type of the support, the number and composition of the imaging forming layers, and the kinds of auxiliary layers that are included in the elements. Typical supports include cellulose nitrate film, cellulose acetate film, poly(vinyl acetal) film, polystyrene film, poly(ethylene terephthalate) film, poly(ethylene naphthalate) film, polycarbonate film, and the like.

The dispersed polymer particles present in the outermost layer of the photographic element of the present invention can be made by various processes well-known in the art (see, for example, Padget, J. C. in *Journal of Coating Technology*, Vol 66, No. 839, pages 89–105, 1994; Arnoldus, R. in *Waterbourn Coatings, Surface Coating*-3, Ed. by Wilson, A. D., Nicholson, J. W., Prosser, H. J., Elsevier Applied Science, 1990, page 179; El-Aasser, M. S. and Fitch, R. M. Ed. *Future Directions in Polymer Colloids*, NATO ASI Series, No 138, Martinus Nijhoff Publishers, 1987, pages 3–104).

Any suitable ethylenically unsaturated monomers may be used for the preparation of dispersed polymer particles of the present invention such as, acrylic monomers, including acrylic acid, or methacrylic acid, and their alkyl esters such as methyl methacrylate, ethyl methacrylate, butyl methacrylate, ethyl acrylate, butyl acrylate, hexyl acrylate, n-octyl acrylate, lauryl methacrylate, 2-ethylhexyl methacrylate, nonyl acrylate, benzyl methacrylate, the hydroxyalkyl esters of the same acids such as 2-hydroxyethyl acrylate, 2-hydroxyethyl methacrylate, and 2-hydroxypropyl methacrylate, and the nitrile and amides of the same acids such as acrylonitrile, methacrylonitrile, acrylamide and methacrylamide; vinyl monomers, such as, vinyl acetate, vinyl propionate, vinylidene chloride, vinyl chloride, and vinyl aromatic compounds such as styrene, t-butyl styrene and vinyl toluene. Other comonomers which may be used in combination with any of the foregoing monomers include dialkyl maleates, dialkyl itaconates, dialkyl methylene-malonates, isoprene, and butadiene. In addition, crosslinking comonomers can be used to crosslink the polymer particles of the present invention to effectively increase the glass transition temperature of the particles. These are monomers which are polyfunctional with respect to the polymerization reaction, and include esters of unsaturated monohydric alcohols with unsaturated monocarboxylic acids, such as allyl methacrylate, allyl acrylate, butenyl acrylate, undecenyl acrylate, undecenyl methacrylate, vinyl acrylate, and vinyl methacrylate, dienes such as butadiene and isoprene, esters of saturated glycols or diols with unsaturated monocarboxylic acids, such as ethylene glycol diacrylate, ethylene glycol dimethacrylate, triethylene glycol dimethacrylate, 1,4-butanediol dimethacrylate, 1,3-butanediol dimethacrylate, and polyfunctional aromatic compounds such as divinyl benzene. Other polymers that may comprise the dispersed polymer particles include condensation polymers such as polyurethanes, polyesters, polycarbonates, polyamides, epoxies, and the like.

The dispersed polymer particles in the present invention can be made in the presence of a certain amount of prepolymers, or functionalized oligomers, or macromonomers, which may include, for example, functionalized organosiloxanes prepared by reactions between organohydrosiloxane and multifunctional unsaturated monomers, fluorine-containing polymers, polyester urethanes, polyether urethanes, polyacrylourethanes, and the like.

The dispersed polymer particles of the present invention can contain one phase or two or more incompatible phases. The incompatibility may be determined in various ways known in the art. The use of electron microscopy using staining techniques to emphasize the differences between the appearance of the phases, for example, is such a technique.

The glass transition temperature of the dispersed polymer particles of the present invention can be measured by various well-known techniques such as, for example, dilatometry, calorimetry (differential thermal analysis and differential scanning calorimetry), dielectric, and dynamical mechanical measurements. Such techniques have been described in detail in, for example, Rabek, J. F., *Experimental Methods* in Polymer Chemistry, Wiley-Interscience, Chichester, 1980.

The dispersed polymer particles may contain a hydrophilic group, such as a carboxylic acid group, a phosphoric acid group, a sulfonic acid group, a hydroxyl group, an amide group, a poly(ethylene oxide) group, and the like. The hydrophilic groups can be incorporated into the dispersed particles either during polymerization process or by post polymerization reaction. There is no particular restriction on the amount of hydrophilic groups present, but their amount is preferably in the range of from 0.5 to 30 wt %.

Various permanent matting agents for use in the outermost layer of the photographic element of the present invention include, for example, inorganic particles such as silicone dioxide, barium sulfate, desensitized silver halide, zinc particles, calcium carbonate, and the like; organic particles of cellulose esters, cellulose ethers, starches, addition-type polymers and interpolymers prepared from ethylenically unsaturated monomers such as acrylates including acrylic acid, methacrylates including methacrylic acid, acrylamides and methacrylate amides, itaconic acid and its half esters and diesters, styrenes including substituted styrenes, acrylonitriles and methcrylonitriles, vinyl acetates, vinyl ethers, vinyl and vinylidene halides and olefins. The matte particles can be crosslinked by employing crosslinking monomers such as 1,4-butyleneglycol methacrylate, trimethylolpropane triacetate, allyl methacrylate, diallyl phthalate, divinyl benzene, and the like. Other polymers that may comprise matting particles include condensation polymers such as polyurethanes, polyesters, polyamides, epoxies, and the like. Matte particles useful for the present invasion are described in further detail in *Research Disclosure* No. 308, published December 1989, pages 1008–009. Organic matte particles are preferred.

When the matte particles is polymeric in nature, it may include reactive functional groups which form covalent bonds with binders by intermolecular crosslinking or by reaction with a crosslinking agent (i.e., a hardener). Suitable reactive functional groups include hydroxyl, carboxyl, carbodiimide, epoxide, aziridine, vinyl sulfone, sulfinic acid, active methylene, amino, amide, allyl, and the like. There is not particular restriction on the amount of reactive groups present, but their concentrations are preferably in the range of from 0.5 to 10 weight percent. The particle surface may be surrounded with a layer of colloidal inorganic particles as described in U.S. Pat. No. 5,288,598, or a layer of colloidal polymer latex particles which have affinity with suitable binder as described in U.S. Pat. No. 5,279,934, or a layer of gelatin as described in U.S. Pat. No. 4,855,219.

Processing removable mattes can be used together with a processing survival matte particle in the pratice of the invention to further enhance the resistance of the photographic element to ferrotyping and blocking. Such processing removable matte include particles of, for example, copolymers of alkyl (meth)acrylates and methacrylic acid, or acrylic acid, or itaconic acid, copolymers of alkyl (meth) acrylates and maleic monoesters or monoamides, copolymers of styrene or vinyl toluene and a,b-unsaturated mono- or di-carboxylic acids, or dicarboxylic monoesters or monoamides, graft copolymers containing maleic anhydride or methacrylic acid, and dicarboxylic acid mono-ester of a cellulose derivative, such as phthalate and hexahydro phthalate of methyl cellulose, hydroxyethyl cellulose, or hydroxypropylomethyl cellulose. Such processing soluble mattes are described in further detail in U.S. Pat. Nos. 2,992,101; 3,767,448; 4,094,848; 4,447,525; and 4,524,131.

The types of ultraviolet ray absorbers (UV dyes) used in the present invasion are not particularly limited provided their absorption maximum wavelengths fall within the range from 300 to 400 nm, and they have no harmful effect on the photographic properties of the element. Such UV dyes include ultraviolet absorbers of the thiazolidone type, the benzotriazole type, the acrylonitrile type, the benzophenone type, and the aminobutadiene type and have been described in detail in, for example, U.S. Pat. Nos. 1,023,859; 2,685,512; 2,739,888; 2,748,021; 3,004,896; 3,052,636; 3,215,530; 3,253,921; 3,533,794; 3,692,525; 3,705,805; 3,707,375; 3,738,837; 3,754,919; and British Patent No. 1,321,355.

The amount of UV absorbers used in the present invention is in the range of from 0.05 to 1 g/m$^2$, and preferably 0.1 to 0.5 g/m$^2$. The aforementioned UV absorbers are so selected as to have an absorption maximum in a wavelength region required for the photographic performance, and are used singly or in combination.

The UV dyes used for the present invention are preferably used in a pre-dispersion form (UV dye dispersion), which can be prepared, for example, by dissolving the UV dye in a high boiling organic solvent and then adding the resulting solution in an aqueous gelatin solution containing a surfactant such as, for example, sodium dodecyl sufonate. The mixture is stirred at high speed to make an emulsified dispersion, and the dispersion is added to the coating liquid, which is then coated. Those UV absorbers which are liquid at room temperature can be emulsified and dispersed without the use of high boiling organic solvent, and are preferable in the present invention. Typical high boiling organic solvents useful for the present invention have a boiling point of 175° C. or more at atmospheric pressure, and include, for example, phthalic esters, e.g., dibutyl phthalate, dipentyl phthalate, didodecyl phthalate, didecyl phthalate, diethylhexyl phthalate, dicyclohexyl phthalate, phosphanate or phosphanate esters, e.g. tricresyl phosphate, trihexyl phosphate, tri(2-ethyl hexyl) phosphate, tridodecyl phosphate, Benzoate esters, e.g., 2-ethylhexyl benzoate, dodecyl benzoate, 2-ethylhexyl-p-hydroxybenzoate, alcohols and phenols, e.g., p-dodecyl phenol isostearyl alcohol, 2,4-tert-amylphenol, aliphatic carboxylate esters, an aniline derivative, and hydrocarbons. High boiling organic solvents which can be used for the practice of the present invention are described further in detail in, for example, U.S. Pat. No. 2,322,027, WO 94/11787.

Any suitable hydrophilic binder may be used in the outermost layer and the UV layer in practice of the present invention. Gelatin is the most preferred hydrophilic binder. Other hydrophilic binders include both naturally occurring substances such as proteins, protein derivatives, cellulose derivatives (e.g., cellulose esters), polysaccharides, casein, and the like, and synthetic water permeable colloids such as poly(vinyl lactams), acrylamide polymers, poly(vinyl alcohol) and its derivatives, hydrolyzed polyvinyl acetates, polymers of alkyl and sulfoalkyl acrylates and methacrylates, polyamides, polyvinyl pyridine, acrylic acid polymers, maleic anhydride copolymers, polyalkylene oxide, methacrylamide copolymers, polyvinyl oxazolidinones, maleic acid copolymers, vinyl amine copolymers, methacrylic acid copolymers, acryloyloxyalkyl sulfonic acid copolymers, vinyl imidazole copolymers, vinyl sulfide copolymers, homopolymer or copolymers containing styrene sulfonic acid, and the like. For crosslinkable binder such as gelatin, the binder is preferably cross-linked so as to provide a high degree of cohesion and adhesion. Crosslinking agents or hardeners which may effectively be used in the coating compositions of the present invention include aldehydes, epoxy compounds, polyfunctional aziridines, vinyl sulfones, methoxyalkyl mealtimes, triazines, polyisocyanates, dioxane derivatives such as dihydroxydioxane, carbodiimides, chrome alum, zirconium sulfate, and the like.

Any lubricant can be used in the outermost layer of the present invention. Typical lubricants include (1) silicone based materials disclosed, for example, in U.S. Pat. Nos. 3,489,567; 3,080,317; 3,042,522; 4,004,927; and 4,047,958; and in British Patent Nos. 955,061 and 1,143,118; (2) higher fatty acids and derivatives, higher alcohols and derivatives, metal salts of higher fatty acids, higher fatty acid esters, higher fatty acid amides, polyhydric alcohol esters of higher fatty acids, etc disclosed in U.S. Pat. Nos. 2,454,043; 2,732,305; 2,976,148; 3,206,311; 3,933,516; 2,588,765; 3,121,060; 3,502,473; 3,042,222; and 4,427,964; in British Patent Nos. 1,263,722; 1,198,387; 1,430,997; 1,466,304; 1,320,757; 1,320,565; and 1,320,756; and in German Patent Nos. 1,284,295 and 1,284,294; (3) liquid paraffin and paraffin or wax like materials such as carnauba wax, natural and synthetic waxes, petroleum waxes, mineral waxes and the like; (4) perfluoro- or fluoro- or fluorochloro-containing materials, which include poly(tetrafluoroethlyene), poly (trifluorochloroethylene), poly(vinylidene fluoride, poly (trifluorochloroethylene-co-vinyl chloride), poly(meth) acrylates or poly(meth)acrylamides containing perfluoroalkyl side groups, and the like. Lubricants useful in the present invention are described in further detail in *Research Disclosure* No. 308, published December 1989, page 1006.

The outermost protective layer useful in the practice of the invention may optionally contain surface active agents, antistatic agents, charge control agents, thickeners, silver halide particles, colloidal inorganic particles, magnetic recording particles, and various other additives. The UV layer useful in the practice of the present invention may optionally contain silver halide particles, antistatic agents, thickeners, surfactants, polymer latex particles, and various other additives.

The protective layer useful in the practice of the invention can be applied by any of a number of well-know techniques, such as dip coating, rod coating, blade coating, air knife coating, gravure coating and reverse roll coating, extrusion coating, slide coating, curtain coating, and the like. After coating, the protective layer is generally dried by simple evaporation, which may be accelerated by known techniques such as convention heating. Known coating and drying methods are described in further detail in *Research Disclosure* No. 308, published December 1989, pages 1007–1008.

The present invention is also directed to a single use camera having incorporated therein a photographic element as described above. Single use cameras are known in the art under various names: film with lens, photosensitive material package unit, box camera and photographic film package. Other names are also used, but regardless of the name, each shares a number of common characteristics. Each is essentially a photographic product (camera) provided with an exposure function and preloaded with a photographic material. The photographic product comprises an inner camera shell loaded with the photographic material, a lens opening and lens, and an outer wrapping(s) of some sort. The photographic material is exposed in a similar manner as any photographic materials are exposed in cameras, and then the product is sent to the developer who removes the photographic material and develops it. Return of the product to the consumer does not normally occur.

Single use cameras and their methods of manufacture and use are described in U.S. Pat. No. 4,801,957; 4,901,097; 4,866,459; 4,849,325; 4,751,536; 4,827,298; European Patent Applications 0 460 400; 0 533 785; 0 537 908; and 0 578 225, all of which are incorporated herein by reference.

The invention will be further illustrated by the following:

COMPARATIVE SAMPLES A–H AND INVENTION EXAMPLES 1–6

Preparation of UV Dye Dispersions

UV-1 is an aqueous dispersion containing 7.5 wt % 3-di-n-hexylaminoallylidene-malononitrile UV absorber, 7.5 wt % 1,4-cyclohexylene dimethylene bis-2-ethylhexanoate high boiling organic solvent, 0.934 wt % of a mixture of di- and tri-isopropyl napthalene sulfonate, sodium salt, sold by DuPont Co. under the trade designation Alkanol XC surfactant, and 7.5 wt % gelatin. Small particles are obtained by using a homogenizer at 3500 psi and at 45° C. The dispersions are sent to a chill chunker and stored at 46° F. until they are remelted for coating. Both UV-2 and UV-3 are prepared in a similar manner. Their compositions are listed in Table 1:

TABLE 1

| UV Dispersion | Composition |
|---|---|
| UV-1 | An aqueous dispersion containing 7.5 wt % 3-di-n-hexylaminoallylidene-malononitrile UV absorber, 7.5 wt % 1,4-cyclohexylene dimethylene bis-2-ethylhexanoate high boiling organic solvent, 0.934 wt % Alkanol XC surfactant, and 7.5 wt % gelatin |
| UV-2 | An aqueous dispersion containing 7.5 wt % propyl 2-cyano-3-(4-methoxyphenyl)-2-propenoate UV absorber, 7.5 wt % 1,4-cyclohexylene dimethylene bis-2-ethylhexanoate high boiling organic solvent, 0.934 wt % Alkanol XC surfactant, and 7.5 wt % gelatin |
| UV-3 | An aqueous dispersion containing 3.75 wt % propyl 2-cyano-3-4-(methoxyphenyl)-2-propenoate UV absorber, 3.75 wt % 3-di-n-hexylaminoallylidene-malononitrile, 5.25 wt % tricresyl phosphate high boiling organic solvent, 0.55 wt % Alkanol XC surfactant, 0.75 wt % irganox 1076, and 10 wt % gelatin |

Dispersed Polymer Particles:

Dispersed polymer particles used in the example coatings are listed in Table 2 together with their glass transition temperature and mean particle size.

TABLE 2

| Polymer Particle | Polymer Composition | Tg, ° C. | Size (μm) |
|---|---|---|---|
| p-1* | Poly(methyl methacrylate-co-sodium styrene sulfonate) 98/2 wt % | 125 | 0.062 |
| P-2* | Poly(ethyl methacrylate-co-sodium styrene sulfonate) 99/1 wt % | 65 | 0.06 |
| P-3 | Poly(methyl methacrylate-co-methacrylic acid) 97/3 wt % | 125 | 0.07 |

*P-1 and p-2 were prepared by emulsion polymerization process in the presence of gelatin (see U.S. Pat. No. 2,958,884). The particle size and glass transition temperature data are for particles in which the gelatin has been removed by enzymolysis.

Preparation of the Photoaraphic Element:

A series of photographic elements are prepared as follows: A cellulose triacetate film support having an antihalation layer on one side and an antistatic backing layer on the other side (as described below) is coated on the antihalation layer with the image forming layers in sequence of Example 2 of U.S. Pat. No. 5,288,598, a slow cyan-dye forming layer, a fast cyan-dye forming layer, an interlayer, a slow magenta dye-forming layer, a fast magenta dye-forming layer, an interlayer, a slow yellow dye-forming layer, a fast yellow dye forming layer. The UV layer is prepared according to the composition in Table 3 and coated on the top of the fast yellow dye forming layer. The outermost layer is prepared according to the composition in Table 4 and coated on the top of the UV layer.

In forming the UV layer of the present invention, the UV-1, UV-2, and UV-3 dispersions are used to form the coating solutions. The coating examples are presented in terms of dry coating compositions.

TABLE 3

| Composition of the UV layer | |
|---|---|
| Gelatin | 0.7 g/m$^2$ |
| Colloidal Silver | 0.215 g/m$^2$ |
| High boiling organic solvent HS-1 or HS-2 | in Table 5 |
| UV Dye-1 | in Table 5 |
| UV Dye-2 | in Table 5 |

HS-1: 1,4-cyclohexylene dimethylene bis-2-ethylhexanoate
HS-2: tricresyl phosphate
UV Dye-1: 3-di-n-hexylaminoallylidenemalononitrile
UV Dye-2: propyl 2-cyano-3-(4-methoxyphenyl)-2-propenoate

TABLE 4

| Composition of the Outermost Layer | |
|---|---|
| Gelatin, Type IV | 0.89 g/m$^2$ |
| Silicone lube, DC-200 (Dow Corning) | 0.04 g/m$^2$ |
| Fluorad FC-134 | 0.004 g/m$^2$ |
| Aerosol OT | 0.0215 g/m$^2$ |
| Surfactant Olin 10G | 0.0273 g/m$^2$ |
| Poly(vinyl toluene-co-divinyl benzene) 80:20 wt %, 1.5 $\mu$m | 0.054 g/m$^2$ |
| Poly(methyl methacrylate-co-methacrylic acid) 45:55 wt %, 2.7 $\mu$m | 0.108 g/m$^2$ |
| Dispersed polymer particle | Table 5 |

In forming the outermost layer of the present invention, aqueous dispersions of matte particles and dispersed polymer particles are used to form the coating solutions. The coating examples are presented in terms of dry coating compositions.

Table 5 shows the compositions of the UV and outermost layers of each photographic element prepared.

TABLE 5

| | Outermost Layer | | UV Layer | | | |
|---|---|---|---|---|---|---|
| Coating No | Polymer | Coverage g/m$^2$ | UV-Dye 1 g/m$^2$ | UV-Dye 2 g/m$^2$ | H.B. Solvent | Coverage g/m$^2$ |
| Sample A | — | — | — | — | — | — |
| Sample B | P-3 | 0.323 | 0 | 0 | — | — |
| Sample C | — | — | 0.054 | 0.054 | HS-1 | 0108 |
| Sample D | — | — | 0.081 | 0.081 | HS-1 | 0.162 |
| Sample E | — | — | 0.094 | 0.094 | HS-1 | 0.188 |
| Sample F | — | — | 0.106 | 0.106 | HS-1 | 0.212 |
| Sample G | — | — | 0.106 | 0.106 | HS-2 | 0.151 |
| Sample H | P-2 | 0.323 | 0.106 | 0.106 | HS-2 | 0.151 |
| Example 1 | P-3 | 0.323 | 0.054 | 0.054 | HS-1 | 0.108 |
| Example 2 | P-3 | 0.323 | 0.081 | 0.081 | HS-1 | 0.162 |
| Example 3 | P-3 | 0.323 | 0.094 | 0.094 | HS-1 | 0.188 |
| Example 4 | P-3 | 0.323 | 0.106 | 0.106 | HS-1 | 0.212 |
| Example 5 | P-3 | 0.323 | 0.106 | 0.106 | HS-2 | 0.151 |
| Example 6 | P-1 | 0.323 | 0.106 | 0.106 | HS-2 | 0.151 |

Taber Scratch and Abrasion Resistance Test

To evaluate the abrasion resistance of the protective overcoat, discs of coatings after processing are placed on a Taber Abrader and abraded in accordance with ASTM method D1044. Since the outermost layer contains matting agents, the measurement based on percentage light transmission or difference in percentage haze (Delta Haze) before and after Taber abrasion cannot be used to measure the abrasion resistance of the coatings. Instead, a Gould Microtopographer 200 is used to measured the surface roughness within the track area of the samples after Taber abrasion. The surface roughness is then analyzed in terms of two parameters: PPCM which counts the number of scratches produced by Taber wheels per centimeter and Ra which acounts for the average surface roughness. The product of the two (Ra× PPCM ) is used here to quantify how badly the sample surface is scratched. The larger the Ra×PPCM value, the poorer the scratch resistance of the sample. The results are summarized in Table 6.

Evaluation of Ferrotyping Resistance

Six strips of the feature film (raw or processed) are placed in a 80% relative humidity (RH) chamber for a minimum of 16 hours. The strips are stacked, sensitized side to unsensitized side and wrapped in foil, placed inside a moisture proof wrap, and sealed. The sealed package is then placed above a flat glass plate and under a brass bar of the same size with weight of 15 lbs. The package, with the glass plate and brass bar is then placed in a 100° F. room for 17 hours. After storage, the bag is opened, the top and bottom strips are discarded, and the remaining strips are visually inspected for ferrotyping against the following scale:

| Value | % of area showing ferrotyping |
|---|---|
| A | 0 to <5 |
| B | 5 to <20% |
| C | 20 to <50% |
| D | 50 to 100 |

The testing results are reported in Table 6.

TABLE 6

| Coating No | RaxPPCM | Ferrotyping (Raw) 80% RH/100° F. | Ferrotyping (Processed) 80% RH/100° F. |
|---|---|---|---|
| Sample A | 12.5 | A | C |
| Sample B | 13.6 | A | B |
| Sample C | 12.3 | A | C |
| Sample D | 37.5 | A | D |
| Sample E | 37.8 | A | D |
| Sample F | 45.1 | A | D |
| Sample G | 23.2 | A | C |
| Sample H | 23.8 | A | D |
| Example 1 | 8.6 | A | B |
| Example 2 | 14.8 | A | B |
| Example 3 | 20.6 | A | B |
| Example 4 | 33.2 | A | B |
| Example 5 | 10.0 | A | B |
| Example 6 | 15.2 | A | B |

The comparative samples A and B contain neither high boiling organic solvent nor UV dyes in the UV layer. The use of 0.323 g/m$^2$ of P-3 polymer particles in the outermost layer (Sample B) has no effect on the scratch resistance of the outermost layer. The comparative samples A and C–H shows that the scratch resistance of the outermost protective layer becomes increasingly worse as the level of UV dyes and high boiling organic solvent in the UV layer increases. For example, at a fixed gelatin coverage in the UV layer (0.7 g/m$^2$), Sample C contains about 0.216 g/m2 of HS-1 solvent, UV-Dye 1, and UV-Dye 2 and has a Ra×PPCM value of about 12.3. Sample E contains about 0.376 g/m$^2$ of HS-1, UV-Dye 1, and UV-Dye-2, and has a Ra×PPCM value of about 37.8. It is not clear why an increase in the level of high boiling organic solvent and UV dyes in the UV layer has caused such a significant decrease in the scratch resistance of the outermost protective layer. However, the use of 0.323 g/m$^2$ of P-3 polymer particles in the outermost layer has reduced the Ra×PPCM values from 12.3 to 8.6 (Sample C and Example 1), and from 37.8 to 20.6 (Sample E and Example 3), and therefore has improved significantly the scratch resistance of the outermost protective layer. Sample G contains about 0.302 g/m$^2$ of HS-2, UV-Dye 1, and UV-Dye 2, and has a Ra×PPCM value of 23.2. The use of 0.323 g/m$^2$ of P-2 polymer particles (Tg=65° C.) in the outermost layer has resulted no improvement in the scratch resistance of the outermost protective layer (Ra×PPCM=23.8). However, the use of 0.323 g/m$^2$ of either P-1 or P-3 polymer particles (Tg=125° C.) in the outermost protective layer has resulted in a significant improvement in the scratch resistance of the outermost protective layer. Table 6 also shows that the photographic elements prepared according to the present invention have a superior post-process ferrotyping resistance compared to the photographic elements with conventional constructions.

The photographic processing steps to which the raw film may be subject may include, but are not limited to the following:

1.) color developing→bleach-fixing→washing/stabilizing;

2.) color developing→bleaching→fixing→washing/stabilizing;

3.) color developing→bleaching→bleach-fixing→washing/stabilizing;

4.) color developing→stopping→washing→bleaching→washing→fixing→washing/stabilizing;

5.) color developing→bleach-fixing→fixing→washing/stabilizing;

6.) color developing→bleaching→bleach-fixing→fixing→washing/stabilizing;

Among the processing steps indicated above, the steps 1), 2), 3), and 4) are preferably applied. Additionally, each of the steps indicated can be used with multistage applications as described in Hahm, U.S. Pat. No. 4,719,173, with co-current, counter-current, and contraco arrangements for replenishment and operation of the multistage processor.

Any photographic processor known to the art can be used to process the photosensitive materials described herein. For instance, large volume processors, and so-called minilab and microlab processors may be used. Particularly advantageous would be the use of Low Volume Thin Tank processors as described in the following references: WO 92/10790; WO 92/17819; WO 93/04404; WO 92/17370; WO 91/19226; WO 91/12567; WO 92/07302; WO 93/00612; WO 92/07301; WO 02/09932; U.S. Pat. No. 5,294,956; EP 559,027; U.S. Pat. No. 5,179,404; EP 559,025; U.S. Pat. No. 5,270,762; EP 559,026; U.S. Pat. No. 5,313,243; U.S. Pat. No. 5,339,131.

What is claimed is:

1. A silver halide photographic element comprises a support having thereon at least one light-sensitive silver halide emulsion layer and a light-insensitive protective layer, the light-insensitive protective layer comprising an ultraviolet absorbing layer closer to the support and an outermost protective layer, the ultraviolet absorbing layer comprising an ultraviolet aborbing dye, a high boiling organic solvent, and a hydrophilic binder, the outermost protective layer comprising insoluble matte particles having a mean particle size of larger than 0.5 μm, dispersed polymer particles having a mean size of less than 0.2 μm, and a glass transition temperature of at least 70° C., and a hydrophilic binder.

2. The element of claim 1 wherein the insoluble matte particles have a mean particle size of from 0.5 to 10 μm and the dispersed polymer particles having a mean particle size of from 0.01 to 0.2 μm.

3. The element of claim 2 where the dispersed polymer particles have a mean particle size of from 0.02 to 0.15 μm.

4. The element of claim 2 wherein the dispersed polymer particles have a Tg of at least 80° C.

5. The element of claim 1 wherein the insoluble matte particles are organic polymeric particles.

6. The element of claim 1 wherein the high boiling organic solvent has a boiling point greater than 175° C. at atmospheric pressure.

7. The element of claim 1 wherein the hydrophilic binder of both the ultraviolet layer and the outermost protective layer is gelatin.

8. The element of claim 1 wherein the ultraviolet absorbing dye is present in a coverage of from 0.05 to 1 g/m$^2$.

9. The element of claim 1 wherein the outermost layer also contains matte particles that are soluble in processing solutions.

10. The element of claim 1 wherein the dispersed polymer particles contain an acrylic polymer, or a polyurethane, or a polyester.

11. The element of claim 10 wherein the acrylic polymer is poly(methyl methacrylate).

12. The element of claim 1 wherein the dispersed polymer particles contain a hydrophilic group.

13. The element of claim 12 wherein the hydrophilic group is a carboxylic acid, phosphoric acid, or a sulfonic acid group.

14. The element of claim 1 wherein the dispersed polymer particles are crosslinked.

15. The element of claim 5 wherein the insoluble matte particles contain a hydrophilic group.

16. The element of claim 5 wherein the matte particles are crosslinked.

* * * * *